US005837324A

United States Patent [19]

Yapel et al.

[11] Patent Number: 5,837,324

[45] Date of Patent: Nov. 17, 1998

[54] PROFILED EDGE GUIDE

[75] Inventors: Robert A. Yapel, Oakdale; Aparna V. Bhave, Woodbury; Thomas M. Milbourn, Mahtomedi, all of Minn.

[73] Assignee: Minnesota Mining and Manufacturing Company, St. Paul, Minn.

[21] Appl. No.: 657,842

[22] Filed: May 31, 1996

[51] Int. Cl.[6] ..... B05D 1/30; B05C 5/02; B05C 5/00

[52] U.S. Cl. ..... 427/402; 427/420; 118/324; 118/410; 118/411; 118/DIG. 4

[58] Field of Search ..... 118/411, DIG. 4, 118/324, 410; 427/420, 402

[56] References Cited

U.S. PATENT DOCUMENTS

| | | | |
|---|---|---|---|
| 3,289,632 | 12/1966 | Barstow | 118/412 |
| 5,378,542 | 1/1995 | Hanzalik et al. | 428/483 |
| 5,399,385 | 3/1995 | Joos et al. | 427/420 |
| 5,415,993 | 5/1995 | Hanzalik et al. | 430/619 |
| 5,434,043 | 7/1995 | Zou et al. | 430/619 |
| 5,496,695 | 3/1996 | Simpson et al. | 430/619 |

FOREIGN PATENT DOCUMENTS

| | | | |
|---|---|---|---|
| 0567071A1 | 10/1993 | European Pat. Off. | 427/420 |
| 0 628 863 | 10/1996 | European Pat. Off. . | |
| 3 037 612 | 5/1982 | Germany . | |
| WO 94/08272 | 4/1994 | WIPO . | |

OTHER PUBLICATIONS

Bird et al., "Transport Phenomena," Department of Chemical Engineering, University of Wisconsin, Madison, WI, pp 36–41. (no date).

*Primary Examiner*—Katherine A. Bareford
*Attorney, Agent, or Firm*—Daniel C. Schulte

[57] ABSTRACT

Precise control of the wetting of an edge guide by a coating fluid (i.e., the wetting profile) can be achieved by providing a wetting line below which the coating fluid will wet the surface of the edge guide. Preferably, the height of the wetting line corresponds to a predetermined depth profile of a coating fluid flowing down a coater face. Optionally, a non-wetting surface can be provided above the wetting line, and the non-wetting surface can optionally have a low energy coating provided thereon.

22 Claims, 4 Drawing Sheets

PROFILED EDGE GUIDE

FIELD OF THE INVENTION

The present invention relates to edge guides for die-type coating apparatuses (e.g., slide and curtain coating apparatuses), to coating apparatuses comprising these edge guides, and to methods of using each.

BACKGROUND

Die-type coating methods such as slide and curtain coating methods are known to be useful for coating fluids onto a moving web. In general, slide and curtain coating apparatuses include a coater face with one or more feed slots. A fluid flows from a feed slot, down the coater face to a lower lip, and is then applied to a moving substrate.

Edge guides can be located along the length of the coater face of a slide or curtain coater, to direct flow of fluid down the coater face. With conventional edge guides, the wetting of the edge guide by the coating fluid is determined by the initial wetting of the edge guide by the coating fluid, and thereafter, by the random interactions between the coating fluid and the edge guide as the coating fluid flows past the edge guide. Specific factors that can affect how a coating fluid interacts with an edge guide include the surface tension effects between the coating fluid and the edge guide, the particular chemistry of the coating fluid, the viscosity of the coating fluid, flow rates of the coating fluid or fluids, drying of the coating fluid, and the overall physical properties of the edge guide and of the die. Further complications can arise with the use of multiple feed slots, which introduce coating fluid beneath the already flowing fluid, and can disrupt flow of fluid flowing along the length of the coater face.

Conventional edge guides do not correct for the random interactions between a coating fluid and an edge guide. Conventional edge guides therefore allow variation in the wetting of an edge guide by a coating fluid. One result of this variation can be drying of the coating fluid on the edge guide. If coating fluid is allowed to variably contact surfaces of an edge guide, the coating fluid is allowed an opportunity to dry. The drying or dried coating fluid results in a high viscosity mass of material, or alternatively, a mass of gummy, dried coating material which can extend into the coating fluid film flowing past the edge guide. Often this dried material can cause streaks in the finished coated material, causing waste at the edges of the coated product.

Another possible result of non-uniform wetting along an edge guide can be a nonuniform depth of the coating fluid where the fluid contacts the edge guide; e.g., surface tension effects cause the depth of a coating fluid to be different along the edge guides, compared to the depth of the coating fluid removed from these effects, such as at the center of the slide coater, away from the edge guide. This non-uniform coating fluid depth can translate into the production of a coated material having edges of non-uniform coating thickness. A non-uniform coating thickness can result in uneven drying of the coated material, and significant waste of the non-uniformly coated edges. Uneven drying of the coating fluid can cause complications in the manufacturing process, as when undried material contacts mechanisms within the coating apparatus. Furthermore, the quality of these non-uniformly coated edges will be inconsistent and often substandard. Unacceptable product will be discarded, leading to significant amounts of waste. As an example, on a 130 centimeter wide coated web, non-uniformly coated edges can amount to as much as 4 centimeters on each edge, or in excess of 6% of the coated material.

What is needed but not provided by the prior art is a method of coating a fluid onto a substrate using a slide or a curtain coater, wherein the depth of the coating fluid near the edge guides can be more precisely controlled. The method would allow a more uniform coating of a substrate, especially at the coating edges, resulting in improved quality of the coated product and a reduction of waste during production.

SUMMARY OF THE INVENTION

In the present invention, the wetting of an edge guide is not determined by random interaction between an edge guide, a coating fluid, and a slide coating apparatus, etc. The present invention provides precise control of the wetting of an edge guide by a coating fluid by providing a wetting line below which the coating fluid will wet the surface of the edge guide.

With the present invention there is precise control over the area of an edge guide that is contacted by a coating fluid (the wetting surface), and the area of the edge guide that does not contact the coating fluid (the non-wetting surface). This ability to control contact between the coating fluid and the edge guide allows control of the height of the coating fluid at the edge of the coating fluid, where the coating fluid contacts the edge guide, allowing several advantages over known edge guides. For instance, the edge guides of the present invention prevent drying of the coating fluid along the edge guide, thereby reducing or eliminating edge streaks in a coated material. Improved quality of the coated product results, as well as a reduction in the amount of waste produced during manufacturing. The present invention also provides a more uniform thickness of coating fluid as the coating fluid flows down a face of a slide or curtain coating apparatus, thereby providing a coated product having a more uniform crossweb thickness, especially at the edges. Improved uniformity of the thickness of the coating provides a coated product having improved utility; it allows a larger portion of the coated web to be used, e.g., sold as a coated product. Improved uniformity of thickness of the resulting coating also allows an improved uniformity in drying of the coated material. The elimination of uneven drying at edges of the coated material prevents manufacturing complications such as the accumulation of undried coating material on elements of a coating apparatus.

An aspect of the present invention relates to an edge guide having a wetting surface defined at the top by a wetting line. The wetting line has a physical characteristic that maintains contact between the wetting line and a meniscus of a coating fluid. The wetting line having a profile to provide a desired wetting profile of a fluid that contacts the edge guide. The physical characteristics can preferably be such characteristics as a difference in the surface energy of the edge guide surface above the wetting profile and the surface energy of the edge guide surface below the wetting profile; a corner; or combinations of these characteristics. The wetting profile can be any profile that results in a useful or improved coating method or coated product. Preferably, the coating profile can be a constant straight line, a sloped line, or an approximation of a depth profile of a coating fluid.

Another aspect of the present invention is an edge guide for a coating apparatus. The edge guide comprises a wetting surface and a wetting line. The wetting line defines the top of the wetting surface. The wetting surface is capable of being wetted by a coating fluid, and the wetting line is capable of maintaining contact with the upper surface of a coating fluid to form a meniscus, and to thereby prevent the top surface of the coating fluid from moving away from the wetting line. The wetting line corresponds to the depth profile of a coating fluid flowing down a coater face.

Another aspect of the present invention is a slide coating apparatus having the above-described edge guide fitted thereon. Yet another aspect of the present invention is a method of coating a fluid onto a moving substrate. The method employs a slide or curtain coating apparatus having fitted thereon the above-described edge guide.

DETAILED DESCRIPTION

Figure 1:
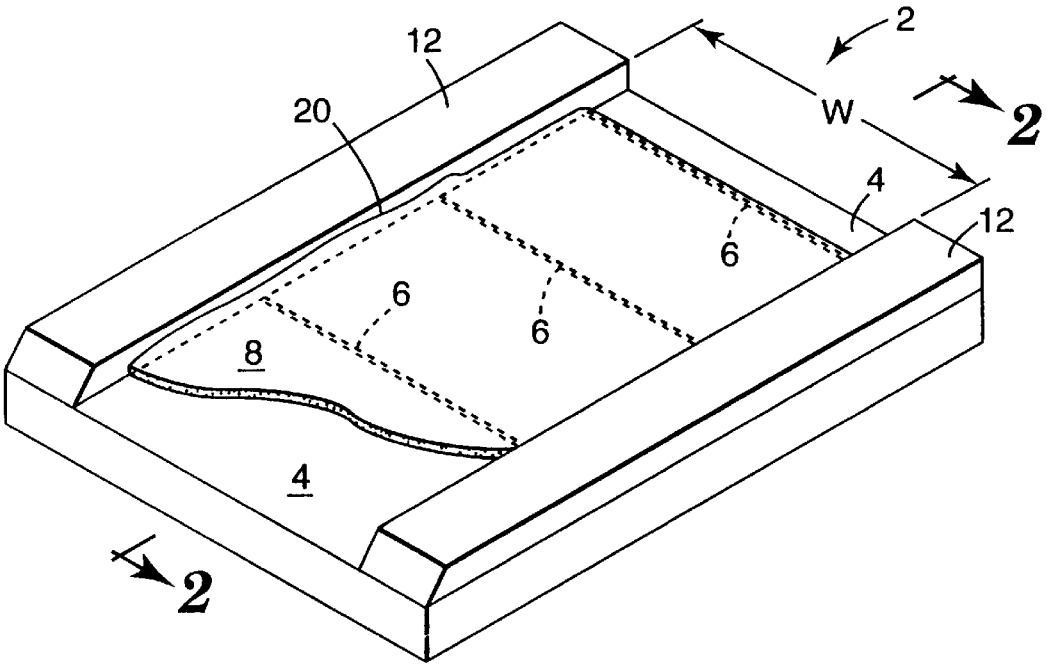
FIG. 1 illustrates a slide coating apparatus having a coater face and coating fluid flowing from multiple feed slots, down the coater face. Edge guides are located at both edges of the coater face.

FIG. 1 illustrates an example of a slide coating apparatus. In the Figure, slide coating apparatus 2 includes coater face 4 having one or more feed slots 6 of slot width w. Coating apparatus 2 further comprises edge guides 12 located along the length of coating apparatus 2. Coating fluid 8 flows from feed slots 6, and flows as a film down coater face 4. The coating fluid contacts surfaces of edge guides 12. It is understood that although the present description describes edge guides in terms of slide coating applications, the edge guides of the present invention can be useful with any coating apparatus of the type comprising a coater face a coating fluid flowing thereover, and optionally comprising multiple feed slots. In particular, the present invention is also useful in combination with curtain coating apparatuses.

Preferably, slide coating apparatus 2 includes two or more feed slots 6 along coater face 4. Multiple feed slots allow the coating of more than a single coating fluid, e.g., multi-layer coatings, as are known in the arts of curtain and slide coating. For example products useful in imaging applications may include multiple layers of coated materials such as one or more light-sensitive layers, antihalation layers, interlayers, etc., as are known in the art. Each of these different coated layers can be coated onto a substrate simultaneously by introducing different coating fluids through different feed slots of a coater face. The different fluids will flow down the coater face in discrete layers, and can be coated onto a substrate as a multi-layer coating. Within the present description, coating fluid that flows down a coater face, whether comprised of a single or multiple layers, will be referred to collectively as "the coating fluid."

In the practice of the present invention, the coating fluid can be any fluid that can be coated by means of a slide or curtain coater, onto a substrate. For instance the coating fluid can be a solvent-based solution, a water-based solution, or a dispersion. The coating fluid can be any of the fluids commonly coated as adhesives, latexes, paints, as elements or layers of a photosensitive material such as a photographic, thermographic, or photothermographic material, as magnetic or nonmagnetic layers of a magnetic medium, etc. Optionally, the coating fluid can be of a composition that can be cured, solidified or crosslinked after being coated, for example by exposure to heat or radiation.

The coating fluid can comprise a solid component that can be any material useful, for example, as an adhesive, as a component or element of a photographic, thermographic, or photothermographic material, as an element or layer of a magnetic recording medium, dyes, radiation-curable materials, abrasive or microabrasive materials, etc. The solvent component can be water or any organic solvent known to be useful in the coating arts, including methyl ethyl ketone (MEK), toluene, tetrahydrofuran (THF), methyl isobutyl ketone (MIBK), or mixtures thereof.

Preferred coating fluids often used in slide coating systems include water-based solutions, emulsions, dispersions, or gels such as those known to be useful in imaging elements such as photographic film, x-ray film, graphic arts film, etc. The solid component of these coating fluids typically includes a binder such as gelatin, polyvinyl alcohol, or an aqueous film-forming latex, and can often include other known and useful ingredients such as radiation-sensitive materials (e.g., silver halide compounds) matting agents, sensitizers, hardeners, etc. The solvent for these elements is typically water, although organic solvent may also be present.

Other preferred coating fluids often used in slide coating systems include organic solvent-based solutions, emulsions, dispersions, or gels such as those known to be useful photothermographic and thermographic imaging elements, photoresists and photopolymers. The solid component of these coating fluids typically includes a binder such as polyvinyl acetal, polyvinyl butyral, polyvinyl acetate, or polyvinyl chloride, and can also include other known and useful ingredients such as light-sensitive materials (e.g., silver halide compounds) matting agents, sensitizers, hardeners, etc. The solvent for these elements is typically an organic solvent such methyl ethyl ketone (2-butanone, MEK), toluene, methanol, or mixtures thereof. Particular examples of preferred coating fluids include the coating fluids described in commonly assigned U.S. patent application No. 08/340,233 (filed Nov. 16, 1994) and in U.S. Pat. Nos. 5,434,043, and 5,496,695, and the organo-gels described in U.S. Pat. Nos. 5,378,542 and 5,415,993, the disclosures of all of these references being incorporated herein by reference.

Figure 3:
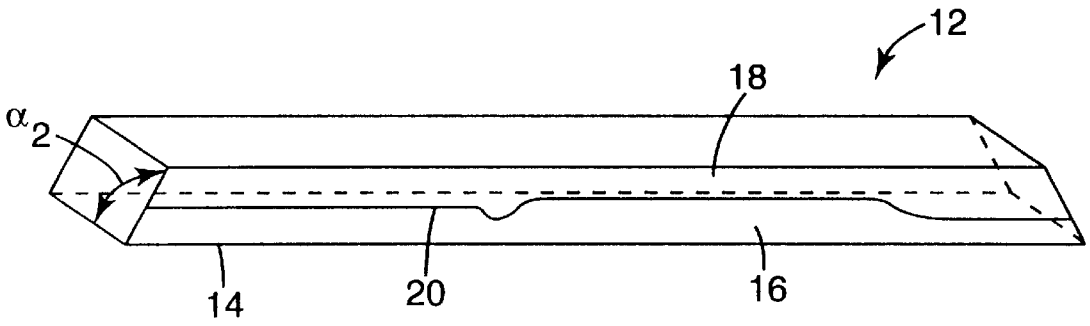
FIGS. 3 and 4 are a perspective views of embodiments of edge guides of the present invention.

An edge guide of the present invention is illustrated in FIG. 3. In the Figure, edge guide 12 comprises bottom surface 14 (optional), wetting surface 16, and non-wetting surface 18. Wetting line 20 exists at the boundary between wetting surface 16 and non-wetting surface 18, and thus defines the area of wetting surface 16 as the area below wetting line 20, and defines the area of non-wetting surface 18 as the area above wetting line 20. Wetting line 20 can have any desired or useful profile (referred to herein as the "wetting profile"). The wetting profile can be any profile that will result in a useful or desirable result in the coating process or coated product. or instance the wetting profile can be a constant (i.e., a straight line), a sloped line, or an approximation of a profile of the coating fluid near the edge guide.

Figure 2:
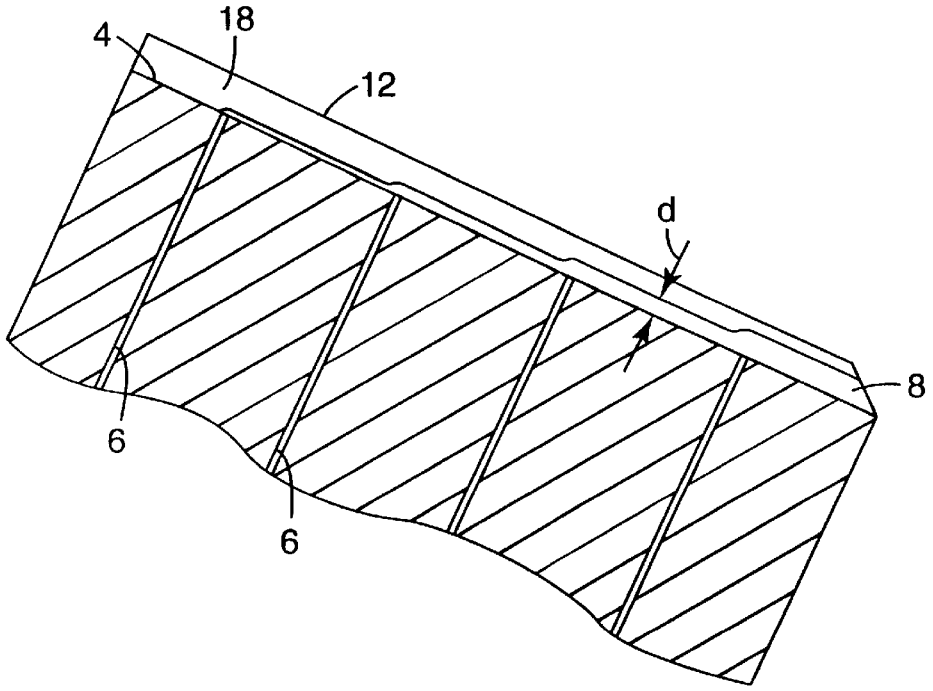
FIG. 2 is a side view of a slide coater, illustrating the varying depth profile of a coating fluid as it flows down a coater face.

In a preferred embodiment of the present invention, the wetting profile corresponds to a predetermined depth profile of a coating fluid. As coating fluid flows from one or more feed slots down a coater face, the depth of the coating fluid above the coater face can vary along the length of the coater face (see FIG. 2). This is especially true if coating fluid flows from multiple feed slots of a coater face. For example, as coating fluid is introduced from a second feed slot to meet coating fluid flowing from a higher feed slot, the depth of the total coating fluid may change (e.g., increase or decrease). Referring to FIG. 2 showing a cut-away view of a slide coating die apparatus, coating fluid 8 flows from multiple feed slots 6 along coater face 4, and the depth of the coating fluid changes along the length of coating apparatus 2.

In a preferred embodiment the wetting profile of an edge guide corresponds to the depth of a coating fluid according to the relationship:

$$h(x)=C_1+d(x) \quad \text{(I)}$$

wherein h is the height of the wetting line above a coater face at a given distance (x) along the length of the coater face, d is the steady state depth of the coating fluid at the same distance along the coater face, and $C_1$ is a constant preferably in the range from about −635 to +635 $\mu$m, with the range from about −381 to +381 $\mu$m being particularly preferred. The steady state depth d of a coating fluid is defined as the depth of the coating fluid at a position on the coater face that is sufficiently distant from an edge of the coating fluid that the coating fluid is unaffected by interactions between the coating fluid and external forces, e.g., surface tension or meniscus forces between the coating fluid and an edge guide, or in the absence of an edge guide, meniscus forces between the coating fluid and the coater face. In other words, steady state depth d is measured at a location where the coating fluid depth does not vary along the width of the coater face, for example, at or near the center of the curtain or slide coater. The "depth profile" of a coating fluid is defined as the continuous or semi-continuous set of points produced by measuring the steady state depth of a coating fluid at a number of locations along the coating fluid's path down the length of the coater face.

Another preferred wetting profile corresponds to the steady state depth profile of a coating fluid multiplied by a constant, according to the relationship:

$$h(x)=C_2d(x) \quad \text{(II)}$$

wherein h and d are as defined above and $C_2$ is a constant preferably in the range from about 0.5 to 1.5, with the range from about 0.8 to 1.2 being particularly preferred.

In the edge guide of the present invention, coating fluid wets the surface of the edge guide below the wetting line (the wetting surface). A coating fluid is considered to "wet" a wetting surface of an edge guide if at equilibrium, the liquid would spread over the wetting surface. This can be measured, for example, by the contact angle between the edge guide and the coating fluid. If the contact angle is zero or nearly zero, the coating fluid is said to wet the edge guide. As an alternative method of defining wetting, a coating fluid is considered to wet an edge guide if the spreading coefficient S of the coating fluid on the edge guide is greater than zero. The spreading coefficient S is defined as the surface energy of the edge guide in equilibrium with the coating fluid vapor ($\sigma_{SV}$), minus the interfacial tension between the edge guide surface and the coating fluid ($\sigma_{SL}$) minus the surface tension of the coating fluid in equilibrium with its vapor ($\sigma_{LV}$):

$$S=\sigma_{SV}-\sigma_{SL}-\sigma_{LV} \quad \text{(III)}$$

(See Edward D. Cohen and Edgar B. Gutoff, *Modern Coating and Drying Technology* pp. 129–30 (1992) ISBN 1-56081-097-1).

Wetting of the wetting surface can be facilitated by adjusting the surface energy of the wetting surface in relation to the surface tension of the coating fluid. In general, the surface energy of the wetting surface should be greater than the surface tension of the coating fluid in order for the coating fluid to wet the wetting surface of the edge guide. Optionally, to facilitate wetting of the wetting surface by the coating fluid the surface energy of a wetting surface can be modified by one of several known techniques, including vapor honing, grit blasting, sand blasting, sanding, grinding, chemical methods such as chemical etching, and mixtures thereof, all of which are known to be useful to increase the surface energy of a surface. Surface energy of a surface can be measured by known methods, for example by the Wilhelmy Plate method (discussed, for example, in Adamson, *Physical Chemistry of surfaces* (4th ed. 1982)). Surface tension of a fluid can be measured by known methods, for example by the Wilhelmy Plate method or the du Nouy Ring method, using a tensiometer such as a Fisher Model 21 Surface Tensiometer. Contact angle can be measured using a Goniometer, such as the NRL Contact Angle Goniometer from Rame-Hart Inc., or with any visualization method.

By ensuring that a coating fluid wets the edge guide up to the wetting line, the depth of the coating fluid near the edge of the coating fluid film can be controlled. The coating fluid contacting the edge guide can be manipulated to reach a desired depth by ensuring that the coating fluid wets the edge guide up to a desired level, defined by the wetting line. This means that the edge of a coating fluid can be controlled to have a desired depth profile, for instance a depth profile that will result in a very uniform thickness profile across the width of a coater face, with improvements being made especially at the edges of the coating fluid.

An edge guide of the present invention can optionally further comprise a "non-wetting" surface adjacent to or above the wetting line. The coating fluid is substantially prevented from contacting the non-wetting surface. By "substantially prevented from contacting" it is meant that there is not a regular flow of coating fluid past the non-wetting surface of the edge guide; incidental contact due to splashing or intermittent flow above the wetting line is not considered to be contact within this definition. Also as used herein the term "non-wetting," as in "non-wetting surface" defines the area of an edge guide that does not actually contact a coating fluid. "Non-wetting" does not necessarily describe a surface that is incapable of being wetted by the coating fluid; the coating fluid may or may not be capable of wetting the non-wetting surface. The non-wetting surface is said to be optional because an edge guide of the present invention could be a flat article of essentially no cross-sectional width, and consisting of merely a wetting surface, the upper edge of the wetting surface being formed into a wetting profile that can hold a meniscus.

In the practice of the present invention, the upper surface of the coating fluid forms a meniscus with the wetting line. This prevents the coating fluid from losing contact with any portion of the wetting surface, and also prevents the coating fluid from contacting the non-wetting surface. The meniscus of the coating fluid can be held on the wetting line be any of a number of techniques. With these techniques, the wetting line can be designed to act as a "pin point" on the edge guide.

Figure 4:
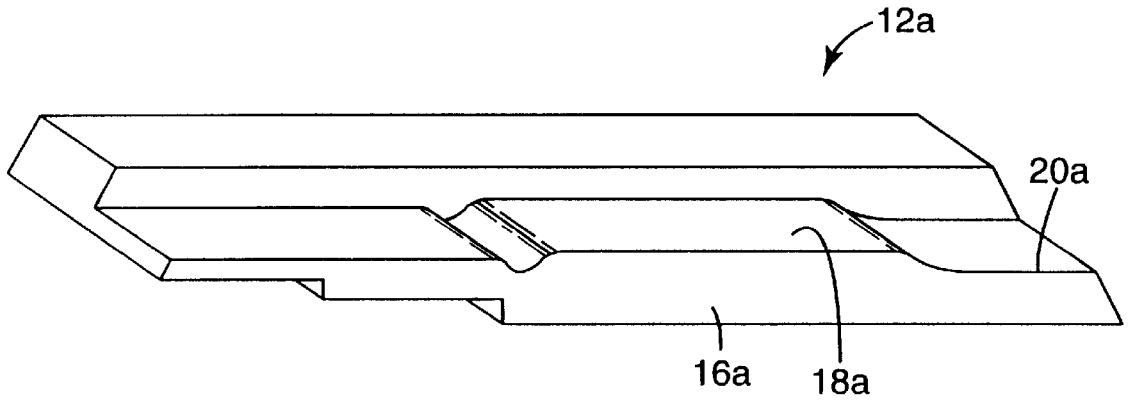

What is referred to as the "pin point" can actually be a feature along the length of an edge guide, as is shown in FIGS. 3 and 4, although the pin point appears as a point when viewed in cross section (see FIGS. 5 through 9). The pin point can comprise a suitable physical feature of an edge guide such as a comer or a groove. Alternatively, the pin point can be the result of the difference between the surface energy of the wetting surface and the surface energy of the non-wetting surface. Or, the pin point can be the result of some other physical or chemical feature of the edge guide, such as a groove or a set of grooves, or the result of a combination of one or more of these features.

A preferred type of a pin point on an edge guide is a difference in surface energy between the wetting surface and the non-wetting surface. As stated above, the coating fluid wets the wetting surface of the edge guide. The coating fluid can be prevented from contacting the non-wetting surface of the edge guide by providing a non-wetting surface that the coating fluid is incapable of wetting. Such a surface can be defined by a number of different criteria. For instance, the non-wetting surface can be defined as having a surface energy below the surface tension of the coating fluid. Defined in terms of the spreading coefficients of the wetting and non-wetting surfaces, the spreading coefficient of the coating fluid on the wetting surface ($S_w$) is preferably greater than the spreading coefficient of the coating fluid on the non-wetting surface ($S_{nw}$), with $S_{nw}$ being preferably less than zero and more preferably much less than zero. Because it may not always be possible in practice to meet the preferred spreading coefficient criteria, a useful difference in surface energies can be created by providing a non-wetting surface having a surface energy $\sigma_{NW}$, that is less than the surface energy of the wetting surface $\sigma_W$.

Figure 5:
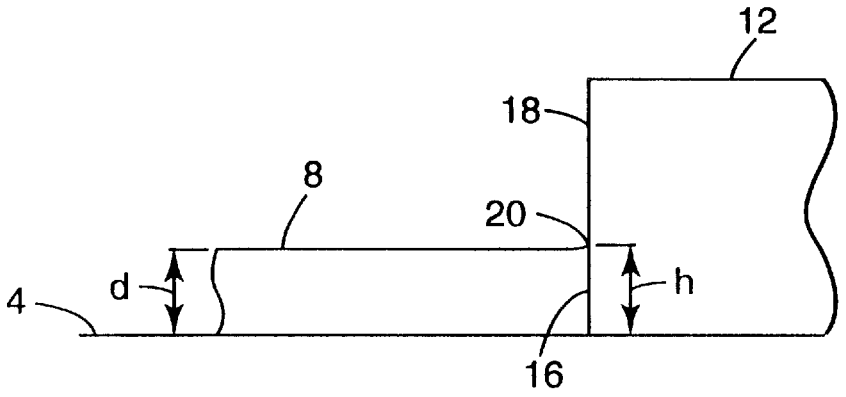
FIGS. 5, 6, 7, 8 and 9 are cross sectional end views of embodiments of edge guides of the present invention, showing a coating fluid flowing down a coater face of a slide coating apparatus and in contact with the edge guide.

An embodiment of the invention having a pin point defined by a difference in surface energy between the wetting surface and the non-wetting surface is illustrated in FIGS. 3 and 5. FIG. 5 is an end view of coating fluid 8 flowing past edge guide 12. In the Figure, edge guide 12 comprises wetting surface 16 and non-wetting surface 18, which meet at wetting line 20. Wetting surface 16 has a surface energy greater than the surface tension of coating fluid 8. In contrast, non-wetting surface 18 has a surface energy below the surface tension of coating fluid 8. As a result, coating fluid 8 contacts and wets wetting surface 16 up to wetting line 20, but does not contact non-wetting surface 18, above wetting line 20. With this arrangement, the depth of coating fluid 8 at or near edge guide 12 can be controlled to a desired level which corresponds to the height h of wetting line 20.

To provide a pin point based on a difference between the surface energies of the wetting surface and the non-wetting surface, a useful surface energy of a non-wetting surface can be any surface energy that prevents a coating fluid from wetting the non-wetting surface. The proper surface energy of the non-wetting surface will depend on factors such as the surface energy of the wetting surface and the surface tension of the coating fluid. A preferred surface energy of a non-wetting surface is below about 20 dynes per centimeter. Low surface energy non-wetting surfaces can be provided, for example, by coating a low surface energy material onto the non-wetting surface of an edge guide. Low surface energy coatings are known in the art, and can be comprised of materials such as fluorocarbon polymers, silicone materials such as silicone-containing polymers, etc. These materials are commercially available, for example from DuPont under the trade name SILVERSTONE.

A preferred low surface energy coating is the durable low surface energy composition described in Applicants copending commonly assigned patent application U.S. patent application Ser. No. 08/659,053 incorporated herein by reference. This durable low surface energy composition comprises the reaction product of (i) a fluorinated oligomer comprising a pendent fluoroaliphatic group, a pendent organic group, and a pendent group capable of reacting with an epoxy-silane, and (ii) an epoxy-silane. Preferably, the fluorinated oligomer comprises an oligomeric aliphatic backbone having bonded thereto: (i) a fluoroaliphatic group having a fully fluorinated terminal group; (ii) an organic group comprising a plurality of carbon atoms and optionally comprising one or more catenary oxygen atoms; and (iii) a group capable of reacting with an epoxy-silane, each fluoroaliphatic group, organic group, and group capable of reacting with an epoxy-silane being independently bonded to the fluoroaliphatic backbone through a covalent bond, a heteroatom, or an organic linking group. Also preferably, the epoxy silane comprises a terminal epoxy group and a terminal polymerizable silane group. Examples of such epoxy silane compounds include: t,130 where m and n are integers from 1 to 4, and R is an aliphatic group of less than 10 carbon atoms, an acyl group of less than 10 carbon atoms, or a group of the formula $(CH_2CH_2O)_j$ Z in which j is an integer of at least 1 and Z is an aliphatic group of less than 10 carbon atoms.

Figure 6:
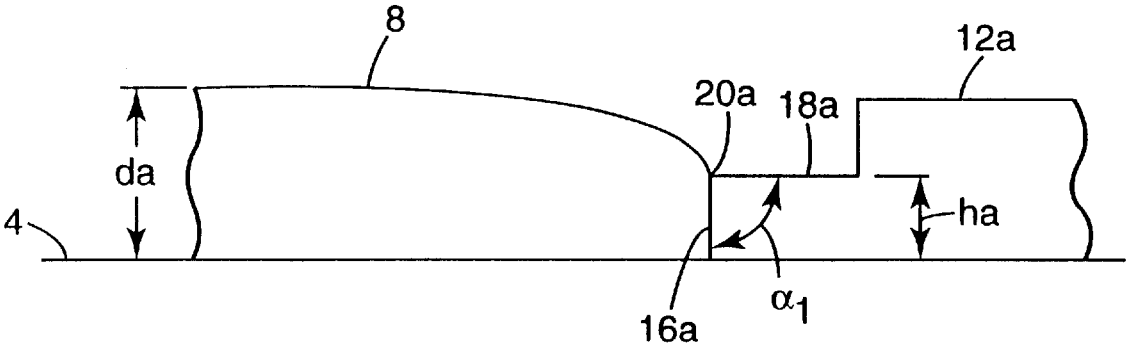
Figure 7:
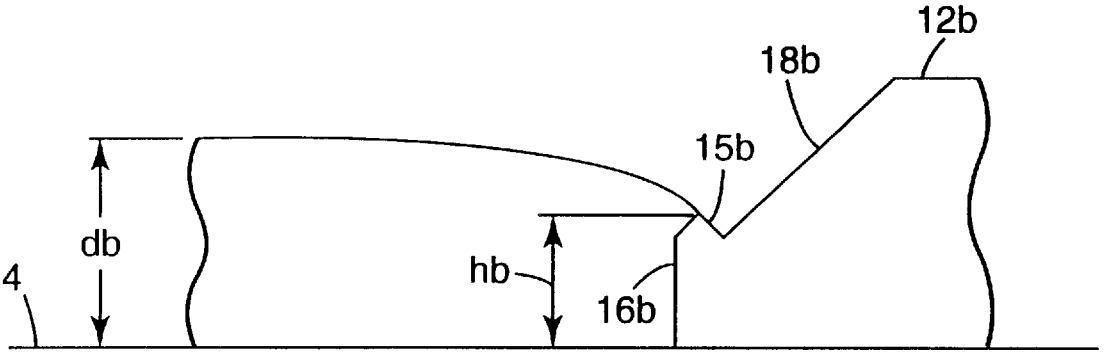

In other embodiments of the present invention, the pin point can be provided by a structural feature of the edge guide, for example a corner located at the wetting line. Corners that suitably act as pin points can have a radius of curvature of less than 100 $\mu$m, preferably less than 50 $\mu$m. An example of this embodiment of the invention is illustrated in FIGS. 4 and 7. FIG. 6 is an end view of coating fluid 8 flowing past edge guide 12*a*. In FIG. 6, coating fluid 8 contacts edge guide 12*a* along wetting surface 16*a*. Wetting surface 16*a* meets non-wetting surface 18*a* at a corner having angle $\alpha_1$ equal to about 90°. The corner between wetting surface 16*a* and non-wetting surface 18*a* pins the upper surface of coating fluid 8 to wetting line 20*a*, forming a meniscus. The entire wetting surface 16*a* contacts coating fluid 8, and the depth of coating fluid 8 at the edge of the coating fluid, where the coating fluid contacts edge guide 12*a*, is controlled. Optionally, non-wetting surface 18*a* can be coated with a low energy material to provide a low energy surface and enhanced pinning of the coating fluid at the wetting line.

In yet another embodiment of the present invention, the non-wetting surface can be recessed from the wetting surface. This embodiment is illustrated in FIG. 7, showing an end view of coating fluid 8 flowing past edge guide 12*b*. In FIG. 7, edge guide 12*b* comprises wetting surface 16*b*, and non-wetting surface 18*b*. Wetting surface 16*b* includes an optional corner which in this embodiment is included to affect viscous drag flow. The non-wetting surface 18*b* is recessed from wetting surface 16*b*, and is comprised of two segments: recessing segment 15*b*, and non-wetting segment 16*b*, either of which can optionally be coated with a low energy coating.

Figure 8:
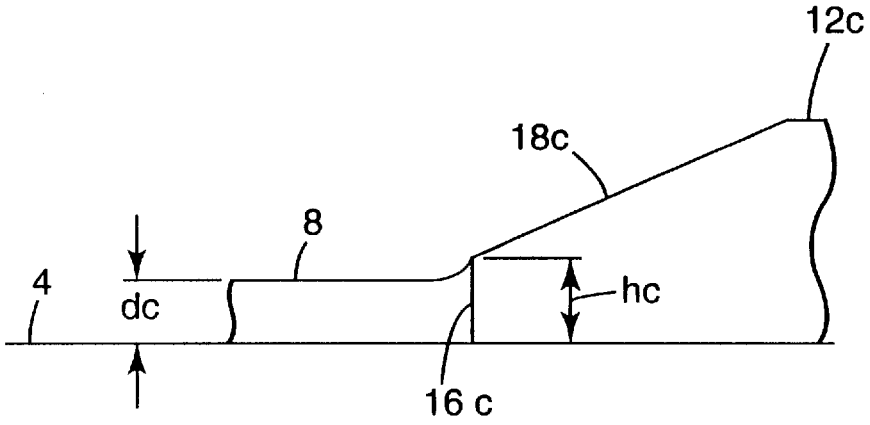

The height h of the wetting line at a given distance x down the coater face can be controlled to be either below the steady state depth d of the coating fluid (h<d), equal to the steady state depth d of the coating (h=d), or greater than the steady state depth d of the coating fluid (h>d) at the same distance. The relationship between h and d can be controlled to provide certain advantages with respect to the coating produced by the present invention. Referring again to FIG. 6, this FIG. illustrates an embodiment of the present invention where h <d. An advantage of a height h less than steady state depth d is a relatively smaller amount of coating fluid at the edge of the coater face (near the edge guide) compared to the amount of coating fluid at the steady state depth d. Such a relationship can reduce or prevent the formation of an edge bead at the edge of the coated material. Alternatively, it is also possible for height h to be greater than steady state depth d. An example of this embodiment is illustrated in FIG. 8, which is an end view of edge guide 12*c* contacting coating fluid 8.

Figure 9:
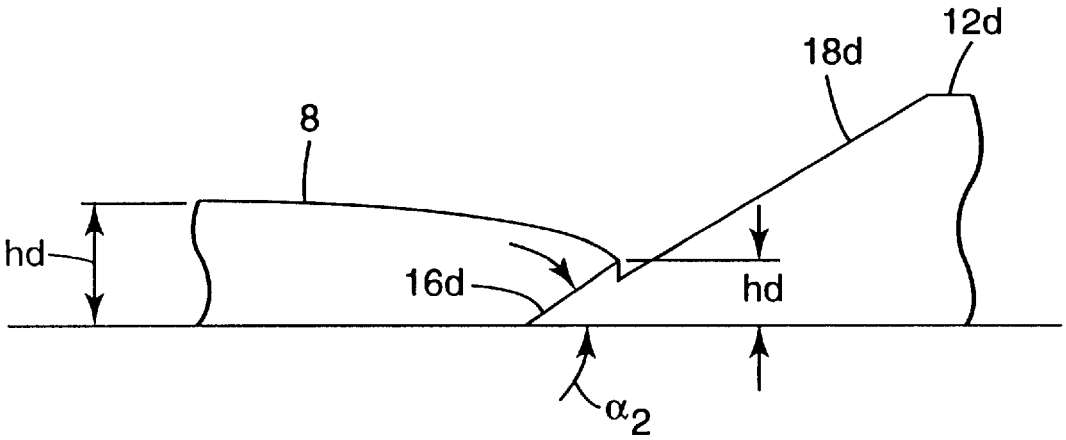

FIG. 9 illustrates an additional embodiment of an edge guide of the present invention. FIG. 9 shows that the angle $\alpha_2$ between a wetting surface and bottom surface of an edge guide can be varied to affect viscous drag flow of a coating fluid, as well as the meniscus shape of a coating fluid in contact with an edge guide. Also, the angle $\alpha_2$ allows variation of the amount of coating fluid that extends beyond the slot width w of a coating apparatus. Reducing the amount of fluid toward the coating fluid edge can affect coater performance by reducing the thickness, width, or both, of any edge bead. On the other hand, as $\alpha_2$ is reduced, a wider but shallower wedge of coating fluid resides along the wetting surface of the edge guide, and this larger surface area of coating fluid is subject to relatively more drag force along the wetting surface of the edge guide. The angle $\alpha_2$ can preferably be in the range from about 35° to 90°.

Bottom surface 14 of the edge guide is an optional surface of the edge guide that can be any surface adapted to fit a coater face of a slide or curtain coater. If the height of the coater face is uniform along its length (e.g., as in FIG. 2), the bottom surface of the edge guide can be flat, as in FIG. 3. If the height of the coater face changes, for example at a feed slot, the bottom surface of the edge guide can be relieved to fit the changes in height of the coater face (e.g., as in FIG. 4). The bottom surface is said to be optional because the bottom surface is included essentially as a means for supporting the edge guide in position. It is possible that an edge guide of the present invention comprise a piece of material with essentially no cross sectional thickness (i.e., no non-wetting surface 18). This type of edge guide could be supported by any useful support means, for example by supporting the ends of the wetting and non-wetting surfaces at the top and bottom of the edge guides. Alternatively, the edge guide could be built into a coater face.

An edge guide according to the present invention can be custom designed for use with a particular coating apparatus. One possible method of producing an edge guide of the present invention is by the modification of a conventional edge guide. The production of edge guides is generally known in the art of slide coating, and these edge guides are typically prepared from materials such as plastics, nylon, Teflon™, Delrin™, steel, aluminum, a ceramic, a composite, etc. Conventional edge guides can be modified according to the present invention by providing on the appropriate edge guide surface a wetting surface defined by a wetting line having a desired wetting profile. A first step in providing this wetting line is to determine the desired wetting profile. A preferred wetting profile corresponds to the steady state depth profile of a coating fluid flowing down a coater face of a slide coater, as defined, for example, by Equations I or II above. The actual depth profile will be different for every coating setup, and will depend on factors including the size, shape, and angle of the coater face, the number of feed slots thereon, the number of coating fluids and the chemical composition thereof, the flow rates of each coating fluid, temperature, the viscosity of the coating fluid(s), etc.

The depth profile of a coating fluid is typically obtained by taking a series of depth measurements along the length of the coater face, each measurement being taken at a point on the slide coater where the depth of the coating fluid has little or no variation along the width of the coater face. A useful location is generally at or near the center of the coater face. The depth profile of a coating fluid can be determined by any of various methods, including hand measurement of coating fluid depths at various distances along a coater face. For example, a liquid depth profilometer can be constructed from a depth measuring device such as a mechanical probe or a non-contact laser gauge, attached to a mechanical slide mechanism. The depth measuring device can be positioned at known locations along the coater face, to take a series of measurements. The points of measurement can be interpolated to produce a continuous or semi-continuous depth profile. As an alternative to physically measuring an actual depth profile, a depth profile can be predicted by analytical or numerical methods, for example using fluid flow modeling products such as FIDAP from Fluid Dynamics International, or NEKTON, from Fluent Corp.

Once a wetting profile is determined, the wetting profile can be incorporated into an edge guide as a wetting line. In an edge guide having a wetting line comprising a boundary between a low surface energy surface and a high surface energy surface, the wetting line can be prepared by masking a portion of a surface of an edge guide followed by altering the surface energy of the unmasked surface. For example, the surface energy of the wetting surface can be increased by masking the non-wetting surface and roughening the wetting surface by any useful method. Next, the wetting surface can be masked (up to the wetting line) and the non-masked (non-wetting) surface can be coated with a low energy coating.

Where the wetting line comprises a structural feature as a pin point, (e.g., a corner) the edge guide can be fabricated by machining the edge guide to include the structural feature at the wetting line. The structural feature can be incorporated into an edge guide by use of a computer controlled machining apparatus such as a grinding apparatus, a milling apparatus, an electrical plasma discharge apparatus, etc., in combination with a Computer Aided Design (CAD) system. In these embodiments the non-wetting surface can optionally be coated with a low surface energy coating.

While the present invention has been described with respect to the noted embodiments, other embodiments and improvements are contemplated. The present invention is not to be construed as being limited to the exemplified embodiments.

What is claimed is:

1. A method of coating a fluid onto a substrate comprising the steps of:

providing a coating fluid;

providing a slide coating apparatus comprising:

a coater face having one or more feed slots, edge guides extending lengthwise along the edges of the slide coater face, the edge guides comprising a wetting surface and a non-wetting surface contacting the wetting surface along a wetting line, the wetting line having a physical characteristic that maintains contact between the wetting line and a surface of the coating fluid flowing down the coater face, the wetting line providing a non-linear wetting profile between the coating fluid and the edge guide;

flowing the coating fluid from the one or more feed slots and down the slide coater face to a substrate.

2. An edge guide for defining an edge of a coating fluid flowing down a coater face, the edge guide having a wetting surface and a non-wetting surface contacting the wetting surface along a wetting line, the wetting line having a physical characteristic that is capable of maintaining contact with a surface of the coating fluid flowing down the coater face, the wetting line providing a non-linear wetting profile between the coating fluid and the edge guide.

3. The edge guide of claim 2, wherein the wetting line is capable of maintaining a depth of the coating fluid next to the edge guide at a desired depth above the coater face.

4. The edge guide of claim 2, wherein the physical characteristic comprises one or more of: a difference in surface energy of the wetting surface of the edge guide and non-wetting surface a corner; and combinations thereof.

5. The edge guide of claim 2, wherein the wetting profile corresponds to a depth profile of the coating fluid.

6. An edge guide for defining an edge of a coating fluid flowing down a coater face, the edge guide comprising a wetting surface and a non-wetting surface contacting the wetting surface along a wetting line, the wetting surface being capable of being wetted by a coating fluid, and the wetting line being capable of maintaining contact with an upper surface of the coating fluid to form a meniscus, wherein the wetting line corresponds to a non-linear depth profile of the coating fluid flowing down the coater face.

7. The edge guide of claim 6, wherein the wetting line corresponds to a steady state depth d according to the relationship:

$$h(x)=C_1+d(x)$$

wherein h is the height of the wetting line above a coater face at a distance x along the length of a slide coater, d is the steady state depth of the coating fluid at the same distance along the length of the slide coater, and $C_1$ is a constant.

8. The edge guide of claim 7, wherein $C_1$ is in the range from about −635 $\mu$m to +635 $\mu$m.

9. The edge guide of claim 6, wherein the wetting line corresponds to a steady state depth d according to the relationship:

$$h(x)=C_2d(x)$$

wherein h is the height of the wetting line above a coater face at a distance x along the length of a slide coater, d is the steady state depth of the coating fluid at the same distance along the length of the slide coater, and $C_2$ is a constant.

10. The edge guide of claim 9, wherein $C_2$ is in the range from about 0.5 to 1.5.

11. The edge guide of claim 10, wherein $C_2$ is in the range from about 0.8 to 1.2.

12. The edge guide of claim 6, wherein the wetting surface has been roughened by a method selected from the group consisting of: vapor honing, grit blasting, sand blasting, sanding, grinding, chemical etching, and mixtures thereof.

13. The edge guide of claims 6, wherein the surface energy of the wetting surface is greater than the surface tension of the coating fluid.

14. The edge guide of claim 6, wherein the non-wetting surface has a surface energy less than a surface tension of the coating fluid.

15. The edge guide of claim 6, wherein the non-wetting surface is coated with a low energy surface comprising a material selected from the group consisting of: a fluorinated polymer, a silicone-containing polymer, and a low surface energy composition comprising the reaction product of (i) an oligomer comprising a pendent fluoroaliphatic group, a pendent organic group, and a pendent group capable of reacting with an epoxy-silane, and (ii) an epoxy-silane.

16. The edge guide of claim 6, wherein a spreading coefficient of the coating fluid on the wetting surface $S_W$ is greater than a spreading coefficient of the coating fluid on the non-wetting surface $S_{NW}$.

17. The edge guide of claim 6, wherein the non-wetting surface has a surface energy below about 20 dyne per centimeter.

18. The edge guide of claim 6, wherein the wetting surface meets the coater face at an angle $\alpha_2$ in the range from about 35° to 90°.

19. The edge guide of claim 6, wherein the wetting line comprises a comer of the edge guide.

20. A slide coating apparatus comprising:

a coater face having one or more feed slots, a coating fluid flowing from the one or more feed slots and down the slide coater face, edge guides extending lengthwise along the edges of the slide coater face, the edge guides comprising a wetting surface and a non-wetting surface contacting the wetting surface along a wetting line, the wetting line having a physical characteristic that maintains contact between the wetting line and a surface of the coating fluid, the wetting line providing a non-linear wetting profile between the fluid and the edge guide.

21. An edge guide for defining an edge of a coating fluid flowing down a coater face, the edge guide having a wetting surface and a non-wetting surface contacting the wetting surface along a wetting line, the wetting line having a physical characteristic that maintains contact between the wetting line and a surface of a coating fluid flowing down the coater face, the wetting line providing a nonlinear wetting profile between the coating fluid and the edge guide, wherein the wetting surface has been roughened by a method selected from the group consisting of: vapor honing, grit blasting, sand blasting, sanding, grinding, chemical etching, and mixtures thereof.

22. An edge guide for defining an edge of a coating fluid flowing down a coater face, the edge guide having a wetting surface and a non-wetting surface contacting the wetting surface along a wetting line, the wetting line having a physical characteristic that maintains contact between the wetting line and a surface of a coating fluid flowing down the coater face, the wetting line providing a nonlinear wetting profile between the coating fluid and the edge guide, wherein a spreading coefficient of the coating fluid on the wetting surface $S_W$ is greater than a spreading coefficient of the coating fluid on the non-wetting surface $S_{NW}$.

* * * * *